US007969101B2

(12) United States Patent
Feng

(10) Patent No.: US 7,969,101 B2
(45) Date of Patent: Jun. 28, 2011

(54) BACKLIGHT CONTROL CIRCUIT HAVING A DUTY RATIO DETERMINING UNIT AND METHOD FOR CONTROLLING LIGHTING OF A LAMP USING SAME

(75) Inventor: Sha Feng, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 473 days.

(21) Appl. No.: 12/283,824

(22) Filed: Sep. 15, 2008

(65) Prior Publication Data

US 2009/0072748 A1 Mar. 19, 2009

(30) Foreign Application Priority Data

Sep. 14, 2007 (CN) ..... 2007 1 0077106

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl. ..... 315/307; 315/291; 315/308

(58) Field of Classification Search ..... None
See application file for complete search history.

(56) References Cited

U.S. PATENT DOCUMENTS

| | | | | |
|---|---|---|---|---|
| 5,907,742 | A | 5/1999 | Johnson et al. | |
| 7,145,295 | B1 * | 12/2006 | Lee et al. | 315/291 |
| 2008/0219030 | A1 * | 9/2008 | Chang | 363/17 |

FOREIGN PATENT DOCUMENTS

| | | | |
|---|---|---|---|
| CN | 1607614 | A | 4/2005 |

* cited by examiner

*Primary Examiner* — Anh Q Tran
(74) *Attorney, Agent, or Firm* — Wei Te Chung

(57) ABSTRACT

An exemplary backlight control circuit includes a lamp, a transformer, and a lamp driving circuit. The lamp driving circuit includes a duty ratio determining unit, a duty ratio adjusting unit, and an output unit. The output unit is configured for outputting two pulse signals having a same duty ratio and opposite phases to the transformer. The transformer is configured for generating an alternating voltage for driving the lamp. The duty ratio determining unit is configured for determining if the duty ratio of the pulse signals is in a predetermined duty ratio range. The duty ratio adjusting unit is configured for adjusting the duty ratio of the pulse signals in order to adjust a brightness of the lamp.

19 Claims, 4 Drawing Sheets

BACKLIGHT CONTROL CIRCUIT HAVING A DUTY RATIO DETERMINING UNIT AND METHOD FOR CONTROLLING LIGHTING OF A LAMP USING SAME

BACKGROUND

1. Technical Field

The present disclosure relates to backlight control circuits, and more particularly to a backlight control circuit including a duty ratio determining unit, and to a method for controlling lighting of a lamp using the backlight control circuit.

2. General Background

Liquid crystal displays are commonly used as display devices for compact electronic apparatuses because they provide good image quality and because they are very thin. A liquid crystal in a liquid crystal display does not emit any light itself. The liquid crystal requires a light source so as to be able to clearly and sharply display text and images. Therefore, a typical liquid crystal display requires an accompanying backlight module. If a cold cathode fluorescent lamp (CCFL) is used in a backlight module, the backlight module generally includes a backlight control circuit. The backlight control circuit is configured for converting a direct current voltage to an alternating current voltage to drive the CCFL.

Referring to FIG. 7, one such backlight control circuit 100 includes a lamp driving circuit 110, a transformer 120, a lamp 130, and a feedback circuit 140. The lamp driving circuit 110 and the transformer 120 constitute an inverter for providing an alternating voltage for driving the lamp 130. The lamp driving circuit 110 is configured for adjusting the alternating voltages provided to the lamp 130 according to a real-time brightness of the lamp 130. The feedback circuit 140 is electrically connected between the lamp driving circuit 110 and the lamp 130. The lamp 130 can, for example, be a cold cathode fluorescent lamp (CCFL).

The lamp driving circuit 110 includes a brightness determining unit 112, a duty ratio adjusting unit 114, and an output unit 118. The brightness determining unit 112 is electrically connected to the duty ratio adjusting unit 114 and the output unit 118, respectively. The duty ratio adjusting unit 114 is further connected to the output unit 118. The transformer 120 includes a primary coil 122 and a secondary coil 124. The primary coil 122 is electrically coupled to the output unit 118 of the lamp driving circuit 110. One terminal of the secondary coil 124 is connected to ground via the lamp 130, and another terminal of the secondary coil 124 is connected to ground via the feedback circuit 140. The feedback circuit 140 is further connected to the brightness determining unit 112.

An exemplary method for controlling lighting of the lamp 130 using the backlight control circuit 100 is as follows. The output unit 118 of the lamp driving circuit 110 outputs two pulse signals DR1 and DR2 to two terminals of the primary coil 122 of the transformer 120, respectively. Referring to FIG. 8, a waveform diagram of the two pulse signals is shown. The two pulse signals DR1 and DR2 have opposite phases and the same duty ratio. The two pulse signals induce the primary coil 122 to generate a current having an alternating direction, thereby inducing the second coil 124 to generate an alternating voltage for driving the lamp 130.

The feedback circuit 140 samples the current in the lamp 130, generates a brightness signal according to the sampling current, and outputs the brightness signal to the brightness determining unit 112. The brightness signal can be a voltage signal.

The brightness determining unit 112 has a reference brightness. The brightness determining unit 112 receives the brightness signal from the feedback circuit 140, compares values of the brightness signal and the reference brightness, and outputs a control signal according to the comparison result.

When the value of the brightness signal is equal to or greater than the value of reference brightness, the brightness determining unit 112 outputs a hold signal to the output unit 118, thus the output unit 118 keeps the two pulse signals invariant according to the hold signal.

When the value of the brightness signal is less than the value of the reference brightness, the brightness determining unit 112 outputs a trigger signal to the duty ratio adjusting unit 114. Thus, the duty ratio adjusting unit 114 outputs a duty ratio adjusting signal to the output unit 118. The output unit 118 adjusts the duty ratio of the two pulse signals upward, thereby increasing the current in the lamp 130 and therefore improving the brightness of the lamp 130.

The reference brightness is set according to a size of the lamp 130 and characters of the backlight control circuit 100. Because different backlight control circuits have different characters, it is possible that the brightness of the lamp 130 can not reach the reference brightness. In general, if the brightness of the lamp 130 is always less than the reference brightness, the duty ratio adjusting unit 114 continuously outputs duty ratio adjusting signals to the output unit 118 such that the output unit 118 continuously increases the duty ratio of the pulse signals. However, when the duty ratio of the pulse signals is greater than an upper range value (50%), the brightness of the lamp 130 can not reach the reference brightness yet, and the backlight control circuit 100 may be switched off because automatic protection is started. Therefore, the backlight control circuit 100 has a low reliability.

Therefore, a new backlight control circuit that can overcome the above-described problems is desired. What is also desired is a method for controlling lighting of a lamp using such a backlight control circuit.

SUMMARY

In one preferred embodiment, a backlight control circuit includes a lamp, a transformer, and a lamp driving circuit. The lamp driving circuit includes a duty ratio determining unit, a duty ratio adjusting unit, and an output unit. The output unit is configured for outputting two pulse signals having a same duty ratio and opposite phases to the transformer. The transformer is configured for generating an alternating voltage for driving the lamp. The duty ratio determining unit is configured for determining if the duty ratio of the pulse signals is in a predetermined duty ratio range. The duty ratio adjusting unit is configured for adjusting the duty ratio of the pulse signals in order to adjust a brightness of the lamp.

Other novel features and advantages will become more apparent from the following detailed description when taken in conjunction with the accompanying drawings.

DETAILED DESCRIPTION

Figure 1:
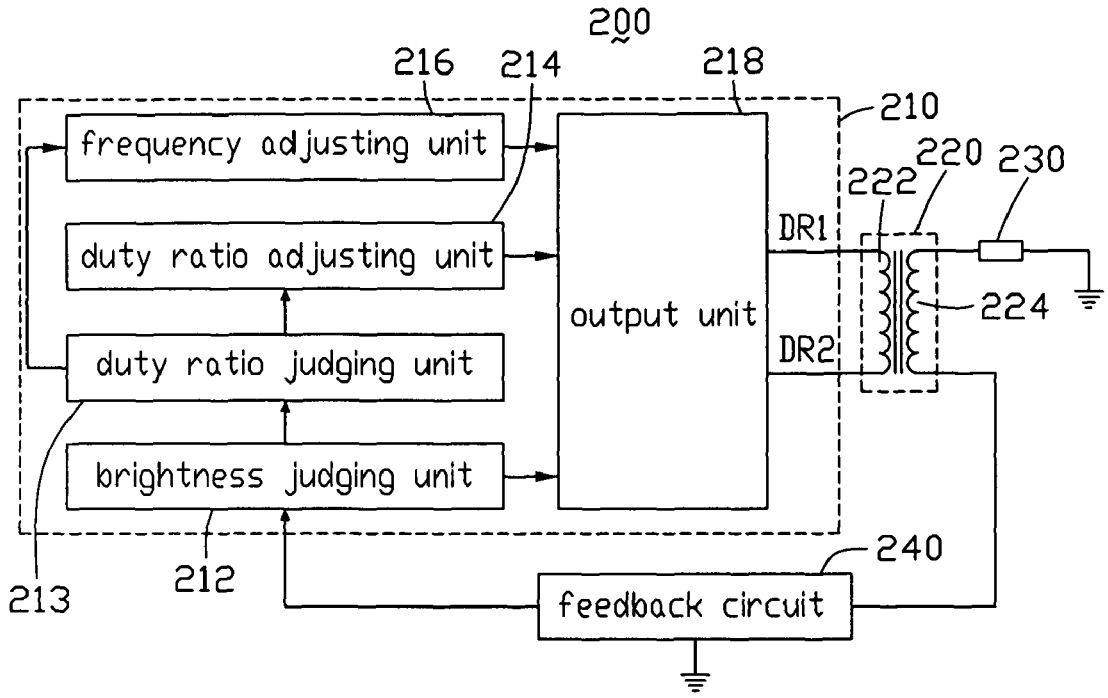
FIG. 1 is a partial diagram of a backlight control circuit according to a first embodiment of the present disclosure, the backlight control circuit including a lamp driving circuit and a lamp.

Referring to FIG. 1, a backlight control circuit 200 according to a first embodiment of the present disclosure is shown. The backlight control circuit 200 includes a lamp driving circuit 210, a transformer 220, a lamp 230, and a feedback circuit 240. The lamp driving circuit 210 and the transformer 220 constitute an inverter for providing an alternating voltage for driving the lamp 230. The lamp driving circuit 210 is configured for adjusting the alternating voltages provided to the lamp 230 according to a real-time brightness of the lamp 230. The feedback circuit 140 is electrically connected between the lamp driving circuit 210 and the lamp 230. The lamp 230 can for example be a cold cathode fluorescent lamp (CCFL).

In one embodiment, the lamp driving circuit 210 includes a brightness determining unit 212, a duty ratio determining unit 213, a duty ratio adjusting unit 214, a frequency adjusting unit 216, and an output unit 218. The brightness determining unit 212 is electrically connected to the duty ratio determining unit 213 and the output unit 218, respectively. The duty ratio determining unit 213 is further connected to the duty ratio adjusting unit 214 and the frequency adjusting unit 216, respectively. The duty ratio adjusting unit 214 and the frequency adjusting unit 216 are further connected to the output unit 218.

The transformer 220 includes a primary coil 222 and a secondary coil 224. The primary coil 222 is electrically coupled to the output unit 218 of the lamp driving circuit 210. One terminal of the secondary coil 224 is connected to ground via the lamp 230, and another terminal of the secondary coil 224 is connected to ground via the feedback circuit 240. The feedback circuit 240 is further connected to the brightness determining unit 212.

Figure 2:
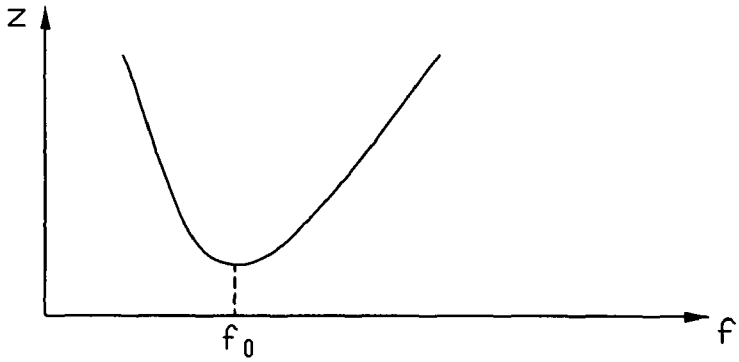
FIG. 2 is a coordinate diagram showing a relationship between a resistance and a driving frequency of the lamp of FIG. 1.

Referring to FIG. 2, a relationship between a resistance of the lamp 230 and a frequency of the alternating voltage applied to the lamp 230 is shown. When the frequency of the alternating voltage is equal to $f_0$, the lamp 230 has a minimum resistance. For illustrative purposes, the frequency of the alternating voltage applied to the lamp 230 is selected less than $f_0$.

Figure 3:
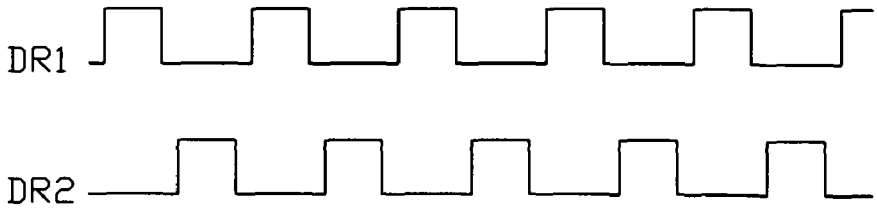
FIG. 3 is a waveform diagram of two pulse signals outputted by the lamp driving circuit of FIG. 1.

An exemplary method for controlling lighting of the lamp 130 using the backlight control circuit 100 is as follows. The output unit 218 of the lamp driving circuit 210 outputs two pulse signals DR1 and DR2 to two terminals of the primary coil 222 of the transformer 220, respectively. Referring to FIG. 3, one embodiment of a waveform diagram of the two pulse signals DR1 and DR2 is shown. The two pulse signals DR1 and DR2 have opposite phases and the same duty ratio. The two pulse signals induce the primary coil 222 to generate a current having an alternating direction, thereby inducing the second coil 224 to generate an alternating voltage for driving the lamp 230.

The feedback circuit 240 samples the current in the lamp 230, generates a brightness signal according to the sampling current, and outputs the brightness signal to the brightness determining unit 212. The brightness signal can be a voltage signal.

The brightness determining unit 212 has a reference brightness. The brightness determining unit 212 receives the brightness signal from the feedback circuit 240, compares values of the brightness signal and the reference brightness, and outputs a control signal according to the comparison result.

When the value of the brightness signal is equal to the value of reference brightness, the brightness determining unit 212 outputs a hold signal to the output unit 218, thus the output unit 218 keeps the two pulse signals invariant according to the hold signal.

When the value of the brightness signal is less than the value of the reference brightness, the brightness determining unit 212 outputs a first trigger signal to the duty ratio determining unit 213. The duty ratio determining unit 213 receives the first trigger signal, and determines if the duty ratio of the two pulse signals is less than or equal to an upper range value (e.g. 50%). If the duty ratio of the pulse signals is less than the upper range value, the duty ratio determining unit 213 outputs a first duty ratio trigger signal to the duty ratio adjusting unit 214. Thus, the duty ratio adjusting unit 214 outputs a first duty ratio adjusting signal to the output circuit 218. The output unit 218 adjusts the duty ratio of the pulse signals upward according to the first duty ratio adjusting signal, thereby increasing the current in the lamp 230 and therefore improving the brightness of the lamp 230. If the duty ratio of the pulse signals is equal to the upper range value, the duty ratio determining unit 213 outputs a first frequency trigger signal to the frequency adjusting unit 216. Thus, the frequency adjusting unit 216 outputs a first frequency adjusting signal to the output unit 218. The output unit 218 adjusts a frequency of the pulse signals upward according to the first frequency adjusting signal, thereby increasing the current in the lamp 230 and therefore improving the brightness of the lamp 230.

When the value of the brightness signal is greater than the value of the reference brightness, the brightness determining unit 212 outputs a second trigger signal to the duty ratio determining unit 213. The duty ratio determining unit 213 receives the second trigger signal, and determines if the duty ratio of the pulse signals is greater than or equal to a lower range value (e.g. 25%). If the duty ratio of the pulse signals is greater than the lower range value, the duty ratio determining unit 213 outputs a second duty ratio trigger signal to the duty ratio adjusting unit 214. Thus, the duty ratio adjusting unit 214 outputs a second duty ratio adjusting signal to the output circuit 218. The output unit 218 adjusts the duty ratio of the pulse signals downward according to the second duty adjusting signal, thereby decreasing the current in the lamp 230 and therefore decreasing the brightness of the lamp 230. If the duty ratio of the pulse signals is equal to the upper range value, the duty ratio determining unit 213 outputs a second frequency trigger signal to the frequency adjusting unit 216. Thus, the frequency adjusting unit 216 outputs a second frequency adjusting signal to the output unit 218. The output unit 218 adjusts a frequency of the pulse signals downward according to the second frequency adjusting signal, thereby decreasing the current in the lamp 230 and therefore decreasing the brightness of the lamp 230.

In summary, the backlight control circuit 200 includes the duty ratio determining unit 214, which can determine if the duty ratio of the pulse signals reaches the upper range value. If yes, the duty ratio of the pulse signals is no longer increased, thus the backlight control circuit 200 can not be abnormally shut down. Therefore, the backlight control circuit 200 has improved reliability. Moreover, when the duty ratio of the pulse signals reaches the upper range value, the frequency adjusting unit 216 is started to adjust the frequency of the pulse signals, whereby making the brightness of the lamp 230 reach the reference brightness.

Figure 4:
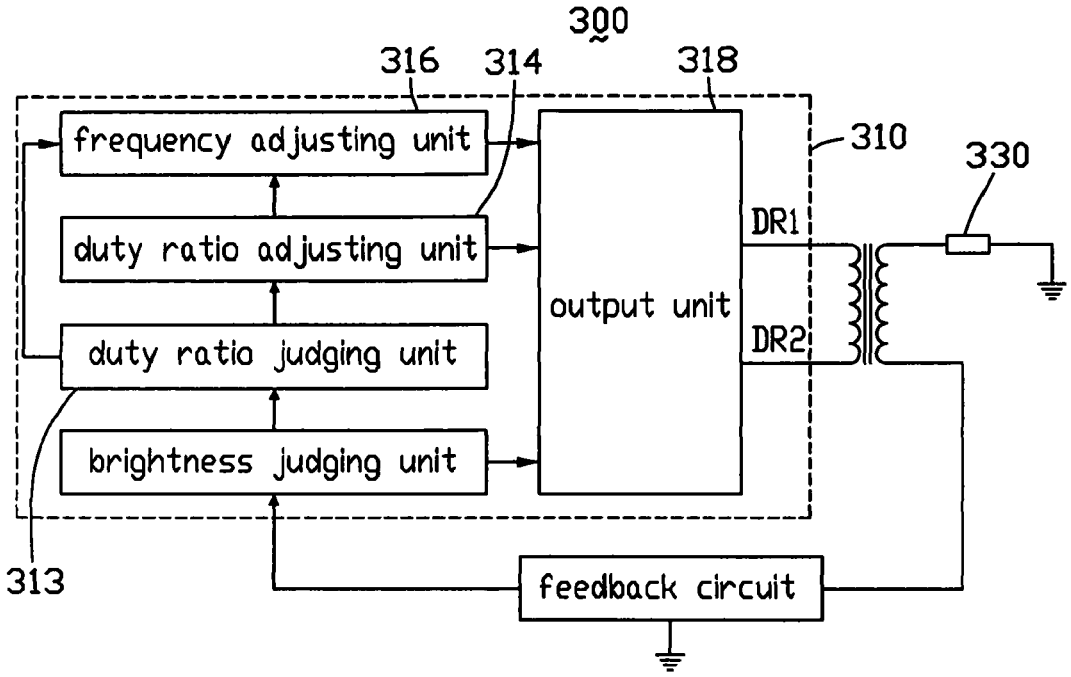
FIG. 4 is a partial diagram of a backlight control circuit according to a second embodiment of the present disclosure.

Referring to FIG. 4, a backlight control circuit 300 according to a second embodiment of the present disclosure. The backlight control circuit 300 is substantially similar to the backlight control circuit 200. However, a duty ratio adjusting unit 314 is further connected to a frequency adjusting unit 316. The backlight control unit comprises a lamp driving circuit 310. When adjusting a brightness of a lamp 330, if a duty ratio determining unit 313 determines a duty ratio of two pulse signals applied to the lamp 330 is between a lower range value and an upper range value, the duty ratio adjusting unit 314 receives a duty ratio trigger signal, and controls the output unit 318 to adjust the duty ratio of the pulse signals. The duty ratio adjusting unit 314 further outputs a frequency trigger signal to start the frequency adjusting unit 316, thus the frequency adjusting unit 316 outputs a frequency adjusting signal to the output unit 318. The output unit 318 adjusts a frequency of the pulse signals according to the frequency adjusting signal.

Figure 5:
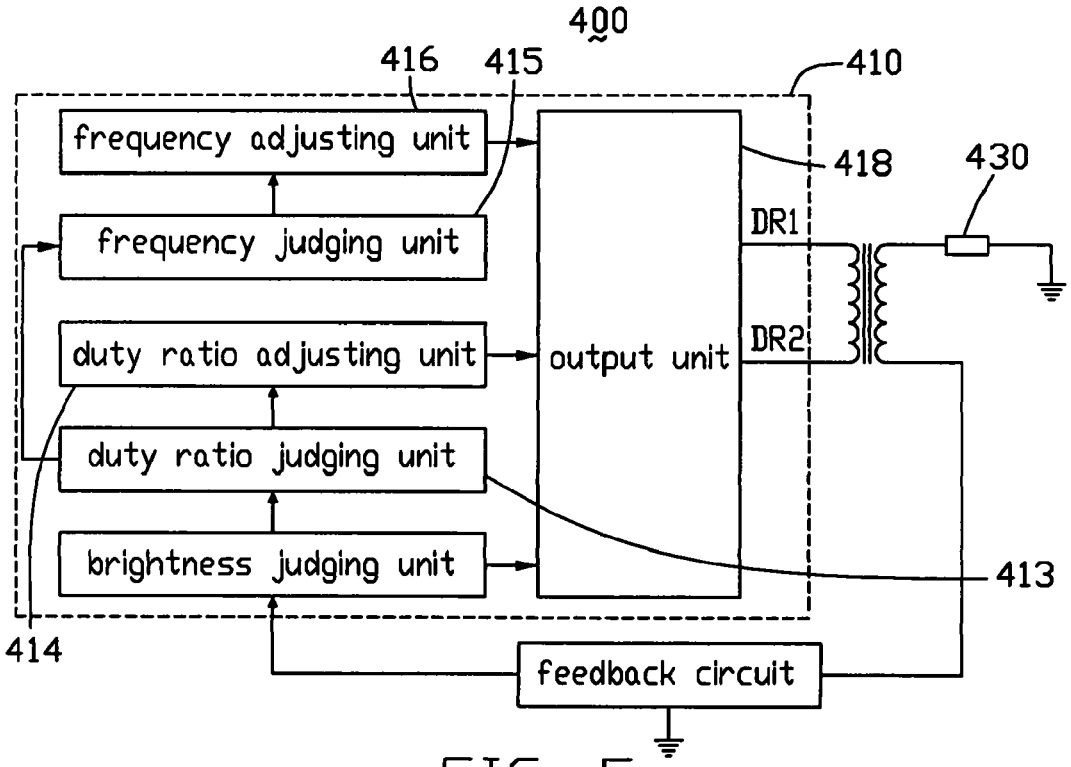
FIG. 5 is a partial diagram of a backlight control circuit according to a third embodiment of the present disclosure.

Referring to FIG. 5, a backlight control circuit 400 according to a third embodiment of the present disclosure is similar to the backlight control circuit 200 of the first embodiment. However, a lamp driving circuit 410 further includes a frequency determining unit 415. A duty ratio determining unit 413 is electrically connected to the frequency determining unit 415, and is not connected to a frequency adjusting unit 416. The frequency determining unit 415 is further connected to the frequency adjusting unit 416.

When adjusting a brightness of a lamp 430, if the duty ratio determining unit 413 determines that a duty ratio of pulse signals applied to the lamp 430 is equal to a lower range value or an upper range value, the duty ratio determining unit 413 outputs a trigger signal to start the frequency determining unit 415. The frequency determining unit 415 determines if a frequency of the pulse signals is in a predetermined frequency range or equal to a lower range value or an upper value of the predetermined frequency range. If the frequency of the pulse signals is in the predetermined frequency range, the frequency determining unit 415 outputs a frequency trigger signal to the frequency adjusting unit 416. Thus, the frequency adjusting unit 416 outputs a frequency adjusting signal to the output unit 418. The output unit 418 adjusts the frequency of the pulse signals according to the frequency adjusting signal. If the frequency of the pulse signal is equal to the lower range value or the upper range value of the predetermined frequency range, the frequency determining unit 415 outputs a hold signal to the output unit 418, thus the output unit 418 keeps the pulse signals invariant according to the hold signal.

In summary, the backlight control circuit 400 further includes the frequency determining unit 415, whereby ensuring that the frequency of the pulse signals is limited in the predetermined frequency range. Therefore, a working life of the lamp 430 is increased because the lamp 430 works with a suitable frequency.

Figure 6:
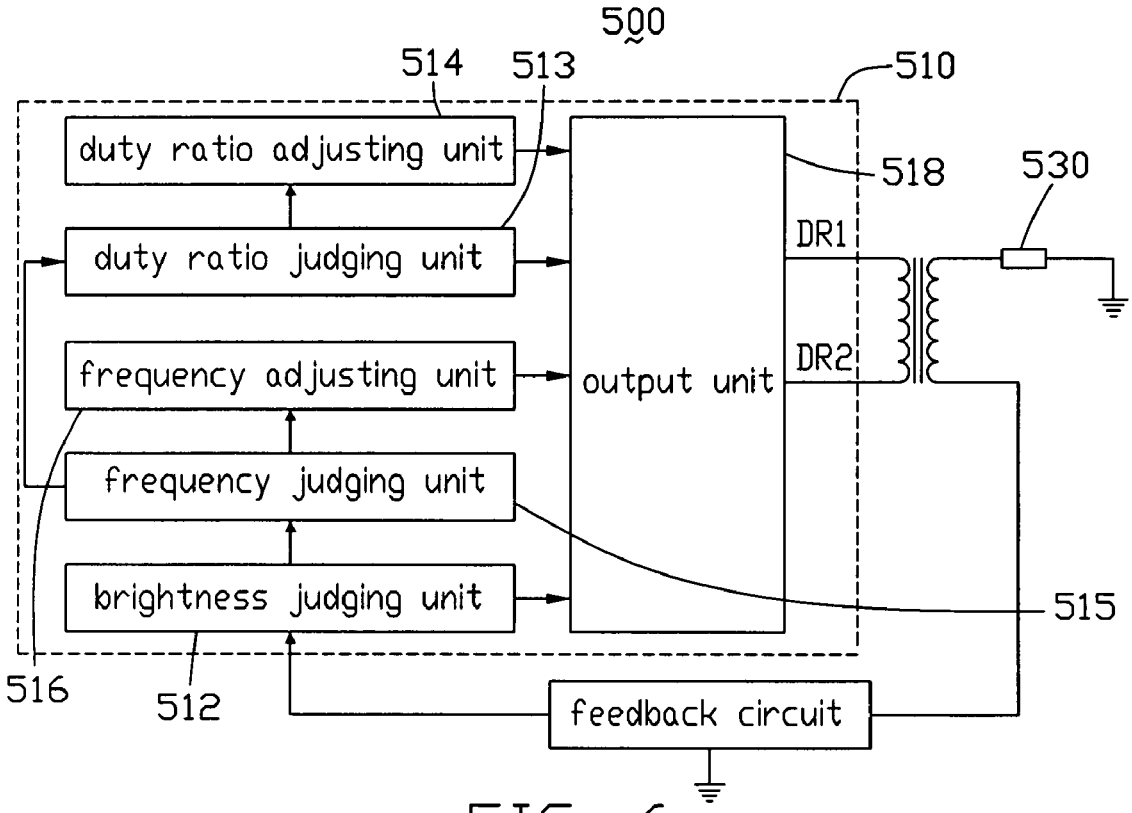
FIG. 6 is a partial diagram of a backlight control circuit according to a fourth embodiment of the present disclosure.
Figure 7:
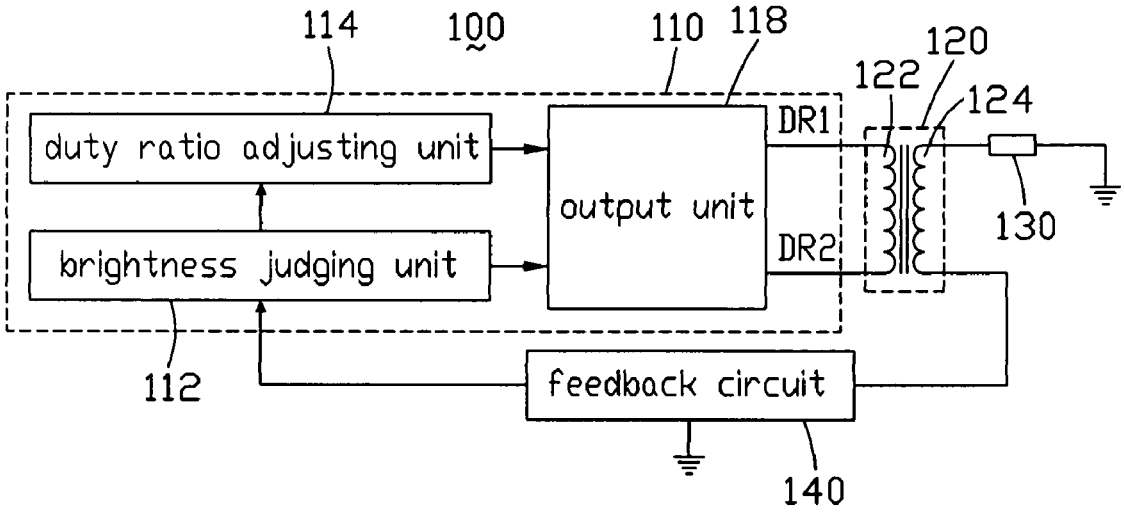
FIG. 7 (RELATED ART)
FIG. 7 is a partial diagram of a conventional backlight control circuit, the backlight control circuit including a lamp driving circuit.
Figure 8:
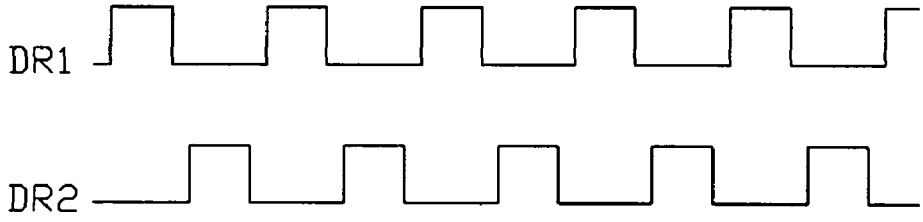
FIG. 8 (RELATED ART)
FIG. 8 is a waveform diagram of two pulse signals outputted by the lamp driving circuit of FIG. 7.

Referring to FIG. 6, a backlight control circuit 500 according to a fourth embodiment of the present disclosure is similar to the backlight control circuit 400. However, a brightness determining unit 512 is connected to a frequency determining unit 515, the frequency determining unit 515 is further connected to a frequency adjusting unit 516 and a duty ratio determining unit 513, the frequency adjusting unit 516 is further connected to an output unit 518, the duty ratio determining unit 513 is further connected to a duty ratio adjusting unit 514 and the output unit 518, and the duty ratio adjusting unit 514 is further connected to the output unit 518.

When adjusting a brightness of a lamp 530, the brightness determining unit 512 outputs a trigger signal to the frequency determining unit 515. Thus, the frequency determining unit 515 determines if a frequency of two pulse signals applied to the lamp 530 is in a predetermined duty ratio range or equal to a lower range value or an upper value of the predetermined duty ratio range. If the frequency of the pulse signals is in the predetermined duty ratio range, the frequency determining unit 515 outputs a frequency trigger signal to the frequency adjusting unit 516. Thus, the frequency adjusting unit 516 outputs a frequency adjusting signal to the output unit 518. The output unit 518 adjusts the frequency of the pulse signals according to the frequency adjusting signal. If the frequency of the pulse signal is equal to the lower range value or the upper range value of the predetermined duty ratio range, the frequency determining unit 515 outputs an another trigger signal to the duty ratio determining unit 513. Thus, the duty ratio determining unit 513 determines if a duty ratio of the pulse signals is in a predetermined duty ratio range. If yes, the duty ratio determining unit 513 outputs a duty ratio trigger signal to the duty ratio adjusting unit 514. Thus, the duty ratio adjusting unit 514 outputs a duty ratio adjusting signal to the output unit 518. The output unit 518 adjusts the duty ratio of the pulse signal according to the duty ratio adjusting signal.

Further or alternative embodiments may include the following. In one example, if the frequency of the alternating voltage applied to the lamp 230 is selected greater than $f_0$, the output unit 218 adjusts the frequency of the pulse signals downward when receiving the first frequency adjusting signal so as to improve the brightness of the lamp 230, and adjusts the frequency of the pulse signals upward when receiving the second frequency adjusting signal so as to decrease the brightness of the lamp 230. In another example, a backlight control circuit further includes a brightness regulator which is connected to a brightness determining unit. In such a case, when a user wants to regulate a brightness of a lamp, the brightness regulator is operated to input an external regulating signal to the brightness determining unit, and the brightness determining unit regulates an initial reference brightness according to the external regulating signal, in order to regulate the brightness of the lamp.

It is to be further understood that even though numerous characteristics and advantages of the present embodiments have been set out in the foregoing description, together with details of the structures and functions of the embodiments, the disclosure is illustrative only; and that changes may be made in detail, especially in matters of shape, size and arrangement of parts within the principles of the disclosure to the full extent indicated by the broad general meaning of the terms in which the appended claims are expressed.

What is claimed is:

1. A backlight control circuit comprising:

a lamp;

a transformer; and a lamp driving circuit comprising a duty ratio determining unit, a duty ratio adjusting unit, and an output unit, the output unit configured for outputting two pulse signals having a same duty ratio and opposite phases to the transformer, the transformer configured for generating an alternating voltage for driving the lamp, the duty ratio determining configured for determining if the duty ratio of the pulse signals is in a predetermined duty ratio range, and the duty ratio adjusting unit configured for adjusting the duty ratio of the pulse signals in order to adjust a brightness of the lamp.

2. The backlight control circuit in claim 1, wherein the lamp driving circuit further comprises a brightness determining unit, the brightness determining unit configured for determining if the brightness of the lamp reaches a reference brightness.

3. The backlight control circuit in claim 2, further comprising a feedback circuit, the feedback circuit configured for sampling a current in the lamp and output a brightness signal to the brightness determining unit.

4. The backlight control circuit in claim 2, wherein when the brightness of the lamp is equal to the reference brightness, the two pulse signals are kept invariant.

5. The backlight control circuit in claim 2, wherein the lamp driving circuit further comprises a frequency adjusting unit, the frequency adjusting unit configured for adjusting a frequency of the pulse signals in order to adjust the brightness of the lamp.

6. The backlight control circuit in claim 5, wherein when the brightness of the lamp is less than the reference brightness, if the duty ratio determining unit determines that the duty ratio of the pulse signals is less than an upper range value of the predetermined duty ratio range, the duty ratio determining unit starts the duty ratio adjusting unit, such that the duty ratio adjusting unit controls the output unit to increase the duty ratio of the pulse signals; if the duty ratio determining unit determines that the duty ratio of the pulse signals is equal to the upper range value of the predetermined duty ratio range, the duty ratio determining unit starts the frequency adjusting unit, such that the frequency adjusting unit controls the output unit to adjust the frequency of the pulse signals to increase the brightness of the lamp.

7. The backlight control circuit in claim 5, wherein when the brightness of the lamp is less than the reference brightness, if the duty ratio determining unit determines that the duty ratio of the pulse signals is less than an upper range value of the predetermined duty ratio range, the duty ratio determining unit starts the duty ratio adjusting unit, such that the duty ratio adjusting unit controls the output unit to increase the duty ratio of the pulse signals and starts the frequency adjusting unit, the frequency adjusting unit controlling the output unit to adjust the frequency of the pulse signals to increase the brightness of the lamp; if the duty ratio determining unit determines that the duty ratio of the pulse signals is equal to the upper range value of the predetermined duty ratio range, the duty ratio determining unit starts the frequency adjusting unit, such that the frequency adjusting unit controls the output unit to adjust the frequency of the pulse signals to increase the brightness of the lamp.

8. The backlight control circuit in claim 5, wherein when the brightness of the lamp is greater than the reference brightness, if the duty ratio determining unit determines that the duty ratio of the pulse signals is greater than a lower range value of the predetermined duty ratio range, the duty ratio determining unit starts the duty ratio adjusting unit, such that the duty ratio adjusting unit controls the output unit to decrease the duty ratio of the pulse signals; if the duty ratio determining unit determines that the duty ratio of the pulse signals is equal to the lower range value of the predetermined duty ratio range, the duty ratio determining unit starts the frequency adjusting unit, such that the frequency adjusting unit controls the output unit to adjust the frequency of the pulse signals to decrease the brightness of the lamp.

9. The backlight control circuit in claim 5, wherein when the brightness of the lamp is greater than the reference brightness, if the duty ratio determining unit determines that the duty ratio of the pulse signals is greater than a lower range value of the predetermined duty ratio range, the duty ratio determining unit starts the duty ratio adjusting unit, such that the duty ratio adjusting unit controls the output unit to adjust the duty ratio of the pulse signals and starts the frequency adjusting unit, the frequency adjusting unit controlling the output unit to adjust the frequency of the pulse signals to decrease the brightness of the lamp; if the duty ratio determining unit determines that the duty ratio of the pulse signals is equal to the lower range value, the duty ratio determining unit starts the frequency adjusting unit, such that the frequency adjusting unit controls the output unit to adjust the frequency of the pulse signals to decrease the brightness of the lamp.

10. The backlight control circuit in claim 5, wherein the lamp driving circuit further comprises a frequency determining unit, the frequency determining unit configured for determining if the frequency of the pulse signals is in a predetermined frequency range.

11. The backlight control circuit in claim 10, wherein when the brightness of the lamp is less than the reference brightness, if the frequency determining unit determines that the frequency of the pulse signals does not reach a lower range value or an upper range value of the predetermined frequency range, the frequency determining unit starts the frequency adjusting unit, such that the frequency adjusting unit controls the output unit to adjust the frequency of the pulse signals to increase the brightness of the lamp; if the frequency determining unit determines that the frequency of the pulse signals is equal to the lower range value or the upper range value of the predetermined frequency range, the frequency determining unit starts the duty ratio determining unit, such that the duty ratio determining unit determines if the duty ratio of the pulse signals reaches an upper range value of the predetermined duty ratio range, if the duty ratio of the pulse signals being less than the upper range value of the predetermined duty ratio range, the duty ratio adjusting unit controlling the output unit to increase the duty ratio of the pulse signals, if the duty ratio of the pulse signals being equal to the upper range value of the predetermined duty ratio range, the duty ratio determining unit starting the duty ratio adjusting unit, such that the duty ratio adjusting unit controlling the output unit to keep the duty ratio of the pulse signals invariant.

12. The backlight control circuit in claim 10, wherein when the brightness of the lamp is less than the reference brightness, if the duty ratio determining unit determines that the duty ratio of the pulse signals is less than an upper range value of the predetermined duty ratio range, the duty ratio determining unit starts the duty ratio adjusting unit, such that the duty ratio adjusting unit controls the output unit to increase the duty ratio of the pulse signals; if the duty ratio determining unit determines that the duty ratio of the pulse signals is equal to the upper range value of the predetermined duty ratio range, the duty ratio determining unit starts the frequency determining unit, such that the frequency determining unit determines if the frequency of the pulse signals reach a lower range value or an upper range value of the predetermined frequency range, if the frequency of the pulse signals being not equal to the lower range value or the upper range value of the predetermined frequency range, the frequency determining unit starting the frequency adjusting unit, such that the frequency adjusting unit controlling the output unit to adjust the frequency of the pulse signals in order to increase the brightness of the lamp.

13. The backlight control circuit in claim 10, wherein when the brightness of the lamp is greater than the reference brightness, if the frequency determining unit determines that the frequency of the pulse signals does not reach a lower range value or an upper range value of the predetermined frequency range, the frequency determining unit starts the frequency adjusting unit, such that the frequency adjusting unit controls the output unit to adjust the frequency of the pulse signals to decrease the brightness of the lamp; if the frequency determining unit determines that the frequency of the pulse signals is equal to the lower range value or the upper range value of the predetermined frequency range, the frequency determining unit starts the duty ratio determining unit, such that the duty ratio determining unit determines if the duty ratio of the pulse signals reaches a lower range value of the predetermined duty ratio range, if the duty ratio of the pulse signals being greater than the lower range value of the predetermined duty ratio range, the duty ratio determining unit starting the duty ratio adjusting unit, such that the duty ratio adjusting unit controlling the output unit to decrease the duty ratio of the pulse signals.

14. The backlight control circuit in claim 10, wherein when the brightness of the lamp is greater than the reference brightness, if the duty ratio determining unit determines that the duty ratio of the pulse signals is greater than a lower range value of the predetermined duty ratio range, the duty ratio determining unit starts the duty ratio adjusting unit, such that the duty ratio adjusting unit controls the output unit to decrease the duty ratio of the pulse signals; if the duty ratio determining unit determines that the duty ratio of the pulse signals is equal to the lower range value of the predetermined duty ratio range, the duty ratio determining unit starts the frequency determining unit, such that the frequency determining unit determines if the frequency of the pulse signals reach a lower range value or an upper range value of the predetermined frequency range, if the frequency of the pulse signals being not equal to the lower range value or the upper range value of the predetermined frequency range, the frequency determining unit starting the frequency adjusting unit, such that the frequency adjusting unit controlling the output unit to adjust the frequency of the pulse signals in order to decrease the brightness of the lamp.

15. The backlight control circuit in claim 1, wherein the lamp is a cold cathode fluorescent lamp.

16. A method for controlling lighting of a lamp, the method comprising:

providing a lamp;

a transformer; and a lamp driving circuit comprising a duty ratio determining unit, a duty ratio adjusting unit, and an output unit, the output unit configured for outputting two pulse signals having a same duty ratio and opposite phases to the transformer, the transformer configured for generating an alternating voltage for driving the lamp, the duty ratio determining configured for determining if the duty ratio of the pulse signals is in a predetermined duty ratio range, and the duty ratio adjusting unit configured for adjusting the duty ratio of the pulse signals in order to adjust a brightness of the lamp, wherein the duty ratio determining unit determining if the duty ratio of the pulse signals are in a predetermined duty ratio range, if the duty ratio of the pulse signals being less than a upper range value of a predetermined duty ratio range and greater than the lower range value of a predetermined duty ratio range, the duty ratio being adjusted in order to adjust the brightness of the lamp.

17. The method in claim 16, further comprising:

the duty ratio of the pulse signals being kept invariant if the duty ratio of the pulse signals being equal to the lower range value or the upper range value.

18. The method in claim 16, further comprising:

a frequency of the pulse signals being adjusted in order to adjust the brightness of the lamp if the duty ratio of the pulse signals being equal to the lower range value or the upper range value.

19. The method in claim 18, wherein the frequency of the pulse signals is limited in a predetermined frequency range.

* * * * *